US006812643B2

(12) United States Patent
Kawasaki et al.

(10) Patent No.: US 6,812,643 B2
(45) Date of Patent: Nov. 2, 2004

(54) FLUORESCENT LUMINOUS TUBE

(75) Inventors: Hiroaki Kawasaki, Chiba (JP); Yukio Ogawa, Chiba (JP); Yoshihisa Yonezawa, Chiba (JP); Katsumi Takayama, Chiba (JP)

(73) Assignee: Futaba Corporation, Chiba (JP)

( * ) Notice: Subject to any disclaimer, the term of this patent is extended or adjusted under 35 U.S.C. 154(b) by 311 days.

(21) Appl. No.: 10/212,210

(22) Filed: Aug. 6, 2002

(65) Prior Publication Data

US 2003/0030378 A1 Feb. 13, 2003

(30) Foreign Application Priority Data

Aug. 7, 2001 (JP) ..... 2001-239045

(51) Int. Cl.[7] ..... H01J 61/04

(52) U.S. Cl. ..... 313/632; 313/491; 313/631

(58) Field of Search ..... 313/491, 631, 313/632

(56) References Cited

FOREIGN PATENT DOCUMENTS

JP 355151755 * 11/1980 ..... 313/497

* cited by examiner

*Primary Examiner*—Vip Patel
(74) *Attorney, Agent, or Firm*—Bacon & Thomas PLLC

(57) ABSTRACT

A fluorescent luminous tube includes a plurality of cathode filaments, a multiplicity of a cathode wirings, each cathode wiring including one or more terminal portions and a wiring portion and being formed of a metal layer, and one or more intermediate portions, each being made of a metal layer. The cathode filament is grouped into at least one set of one or more filaments and filaments in each set are connected in series by fixing an end portion thereof on a terminal portion or an intermediate portion by ultrasonic wire bonding or ultrasonic bonding.

7 Claims, 11 Drawing Sheets

FLUORESCENT LUMINOUS TUBE

FIELD OF THE INVENTION

The present invention relates to a fluorescent luminous tube; and, more particularly, to a fluorescent luminous tube having an improved connecting structure for cathode filaments.

BACKGROUND OF THE INVENTION

FIG. 5A shows a plan view (a partial cross-sectional view) of a conventional fluorescent luminous tube (or fluorescent display device), and FIGS. 5B and 5C depict schematic views of a connecting structure for cathode filaments thereof.

Anode electrodes 63 on which a fluorescent material is deposited are formed on an anode substrate 61 made of an insulating material such as a glass. Grids 64 are arranged between the anode electrodes 63 and filaments 60 to control electrons emitted from the filaments 60 to the anode electrodes 63. The filaments 60 are tightly suspended between an anchor 661 and a support 662 so that a display region 65 is covered. The anchor 661 and the support 662 are fabricated by shaping, e.g., a metal plate, and have three-dimensional shapes. The filament 60 is welded at one end on a resilient filament support member of the anchor 661 and at the other end on a filament support member of the support 662. The anchor 661 and the support 662 are fixed on the anode substrate 61 and are respectively connected to cathode wirings 671 and 672 functioning as take-out leads. Cathode wirings 671 and 672 can be formed as one body with the anchor 661 and the support 662, respectively. A reference numeral 62 represents a side plate made of an insulating material, e.g., a glass.

FIGS. 5B and 5C depict possible arrangements of the display region 65 and the filaments 60 as well as electrical connection of the filaments 60 to the anchor 661 and the support 662. The filaments 60 can be arranged either in a horizontal direction as shown in FIG. 5B or in a vertical direction as shown in FIG. 5C depending on a display pattern of the anode electrodes 63 as shown in FIG. 5A.

If the aspect ratio of the display region 65 is 1:2, the length of a filament 60 in case of FIG. 5B is about twice that of a filament 60 shown in FIG. 5C.

In general, the filaments 60 are fabricated by coating a core wire, made of tungsten or tungsten alloy, with carbonate for emitting thermal electrons. If an electrical current is supplied to the filaments 60, heat is generated in the filaments 60 due to their own resistance and the carbonate heated by the generated heat emits electrons. The temperature of the filaments 60 is normally maintained at about 600 to 650° C. In case each of the filaments 60 has a thickness of about 0.64 MG (a diameter of about 15 $\mu$m), a current of about 27 mA is required to maintain the filament temperature at about 600 to 650° C. In case where a 0.64 MG filament has a length of 25 mm, its resistance value is about 48 Ω. Accordingly, a filament voltage should be set to be 1.3 V in order to apply the current of 27 mA through the 0.64 MG filament having the length of 25 mm.

Assuming that each filament 60 in FIGS. 5B and 5C has the thickness of 0.64 MG and that the length of each of the filaments 60 in case of FIG. 5C is 25 mm, each filament 60 in an arrangement shown in FIG. 5B will be of a length of 50 mm and, thus, a resistance thereof will be 96 Ω. Therefore, a filament voltage in case of FIG. 5B should be set to be 2.6 V, i.e., twice the filament voltage required in FIG. 5C.

As can be seen from the above, since a power source module having a different voltage should be prepared for every filament having a different length, the cost for the power source modules is increased, which in turn raises the manufacturing cost for the fluorescent luminous tube as well.

FIGS. 6A to 6C show various schemes conventionally employed in connecting filaments in series.

FIG. 6A illustrates an example where three filaments 60 are connected in series, in which two anchors 6611 and 6612 and two supports 6621 and 6622 are provided. The anchor 6611 and the support 6621 are connected to cathode wirings 671 and 672, respectively, and the anchor 6612 and the support 6622 are employed for making series connection of filaments 60.

FIG. 6B offers an example where five filaments 60 are connected in series, in which an anchor 6613 and a support 6623 are added to the structure shown in FIG. 6A.

FIG. 6C describes an example where seven filaments 60 are connected in series, in which an anchor 6614 and a support 6624 are further added to the structure illustrated in FIG. 6B.

As shown in FIGS. 6A to 6C, as the number of the filaments 60 is increased to be 3, 5 and 7, both the number of the anchors and the number of the supports are respectively required to be increased to be 2, 3 and 4, accordingly. As a result, the cost for manufacturing and installing the anchors and the supports and for mounting filaments thereon is increased, resulting in the increase of the whole manufacturing cost for the fluorescent luminous tube. Further, it is difficult to scale-down the anchors and the supports because they are required to have predetermined strength. Accordingly, a footprint for mounting the anchors and supports is increased, so that a dead space other than the display region becomes also increased, hampering the fabrication of a scaled down, thin and light-weighted fluorescent luminous tube.

SUMMARY OF THE INVENTION

It is, therefore, an object of the present invention to provide a fluorescent luminous tube using a single power source for various cathode filaments having different lengths and diameters and employing a connecting structure that allows cathode filaments to be easily connected in series in a reduced installation space.

In accordance with the present invention, there is provided a fluorescent luminous tube including a plurality of cathode filaments; a multiplicity of a cathode wirings, each cathode wiring including one or more terminal portions and a wiring portion and being formed of a metal layer; and one or more intermediate portions, each being made of a metal layer, wherein the cathode filament is grouped into at least one set of one or more filaments and filaments in each set are connected in series by fixing an end portion thereof on a terminal portion or an intermediate portion by ultrasonic wire bonding or ultrasonic bonding.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1A:
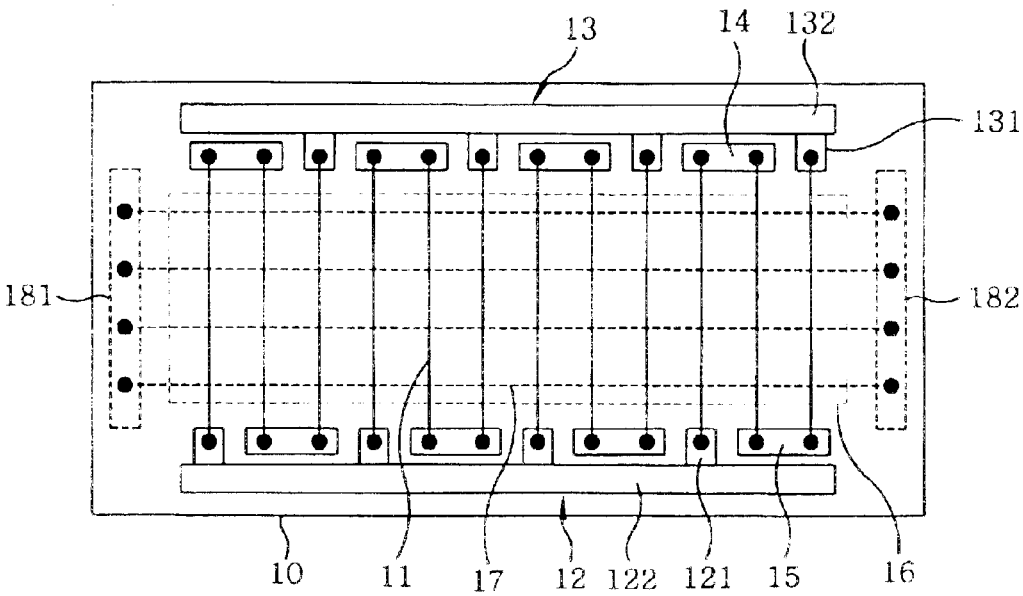
FIGS. 1A to 1C show various connecting structures of cathode filaments of a fluorescent luminous tube in accordance with a first preferred embodiment of the present invention.
Figure 1B:
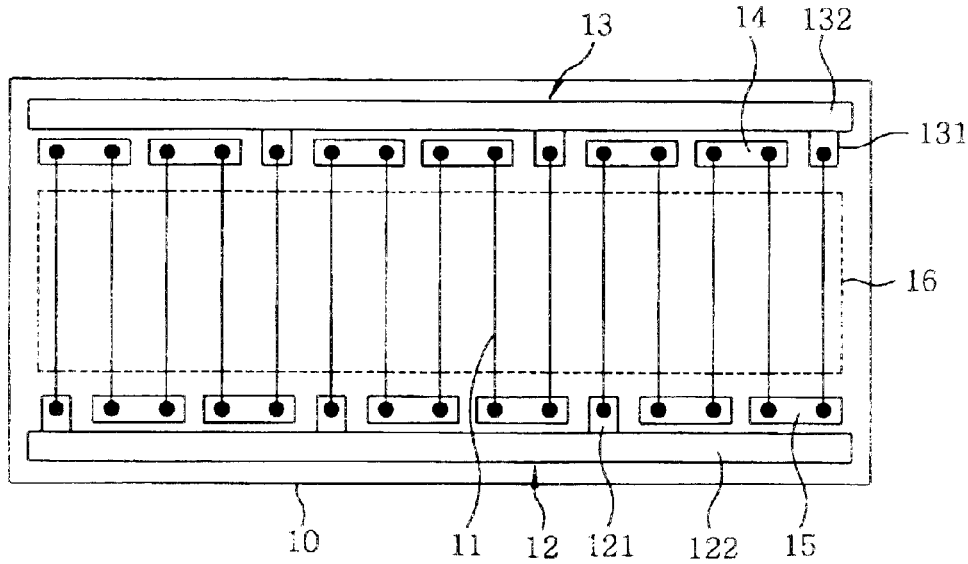
Figure 1C:
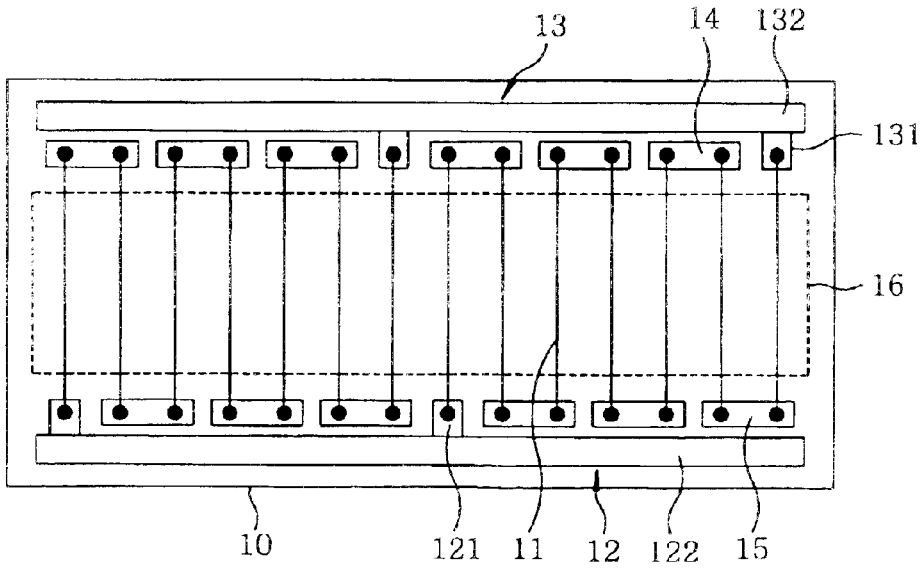

FIGS. 1A to 1C describe various connecting structures of cathode filaments of a fluorescent luminous tube in accordance with a first preferred embodiment of the present invention. The configuration of a fluorescent luminous tube of the present invention is identical to that of the conventional one except for a connection mechanism and a fixation mechanism of the cathode filaments.

Referring to FIG. 1A, a reference numeral 10 denotes a substrate made of an insulation material such as glass, ceramic or the like; 11, cathode filaments; 12 and 13, a couple of cathode wirings (a set of two cathode wirings); 121 and 131, terminal aluminum layers of the cathode wirings 12 and 13, respectively; 122 and 132, wiring aluminum layers of the cathode wirings 12 and 13, respectively; 14 and 15, intermediate aluminum layers for connecting two cathode filaments 11; and 16, a display region. In general, the cathode filaments 11 are fabricated by coating a core wire made of tungsten or tungsten alloy with carbonate for emitting thermal electrons. The wiring aluminum layers 122 and 132, the terminal aluminum layers 121 and 131, the intermediate aluminum layers 14 and 15 are arranged along two opposite sides of the display region.

The wiring aluminum layers 122 and 132, the terminal aluminum layers 121 and 131 and the intermediate aluminum layers 14 and 15 are made of a thin or thick film formed on the substrate 10 by a deposition or a screen printing process.

Each end portion (and a fixation portion around the end portion of the filament 11, to be described later) of the cathode filaments 11 is fixed on one of the terminal aluminum layers 121 and 131 and the intermediate aluminum layers 14 and 15 by an ultrasonic wire bonding technique or an ultrasonic bonding technique to be described later.

FIG. 1A illustrates an example where four sets of three cathode filaments 11 are prepared, wherein the three filaments 11 in each set are connected in series. The cathode filaments 11 are arranged in a vertical direction (i.e., a direction of a shorter side) of the display region 16. As shown for comparison, by dashed lines, filaments 17 can be alternatively arranged in a horizontal direction (a direction of a longer side) of the display region 16. The four filaments 17 are connected in parallel between wiring aluminum layers 181 and 182.

The three filaments 11 in each set are connected in series between a terminal aluminum layer 131 of the cathode wiring 13 and a terminal aluminum layer 121 of the cathode wiring 12 via an intermediate (in view of an electrical connection) aluminum layer 14 or 15. Accordingly, the four sets of three filaments 11 are connected in parallel between the cathode wirings 12 and 13.

If an aspect ratio of the display region 16 is 1:3, a total length of the three filaments 11 in each set is substantially identical to a length of the single filament 17. If the filaments 11 and the filaments 17 have an identical diameter, each set of three filaments 11 has a same resistance as that of a single filament 17. Therefore, the resistance between the cathode wirings 12 and 13 becomes substantially identical to that between the wiring aluminum layers 181 and 182. Therefore, a single filament power source having a predetermined voltage can be used for both the filaments 11 and filaments 17 having different lengths.

If the filament 11 has a length of 25 mm, the filament 17 is of the length of 75 mm. Therefore, when both the filaments 11 and the filaments 17 have a same thickness of about 0.64 MG (a diameter of about 15 $\mu$m), the resistance of one filament 11 is 48 Ω and that of a filament 17 becomes 144 Ω, i.e. three times as large as that of the filament 11. A current of about 27 mA is required to be supplied to each filament 11 having the length of 25 mm in order to maintain the filament at a temperature of about 600 to 650° C. In order to apply the current of about 27 mA to the filament 11 having the length of 25 mm, a filament voltage should be set as 1.3 V. The filament voltage can be AC or DC.

On the other hand, in order to supply the current of about 27 mA to the filament 17 having the length of 75 mm, a filament voltage is required to be 3.9 V. Also, if three filaments 11, each having the length of about 25 mm as described above, are connected in series, a power source having the filament voltage of 3.9 V can be employed as in the case of the filament 17.

If a precision of a voltage generated from the filament power source falls within a range from −10 to 10%, a permitted fluctuation value for an output voltage of the filament power source is set to be ±0.13 V when the filament voltage is 1.3 V and ±0.39 V when the filament voltage is 3.9 V. Thus, if the three filaments 11 connected in series are utilized as one group, the permitted fluctuation value of the output voltage of the filament power source becomes three times as large as that in the case where the filaments are individually utilized. Accordingly, it becomes easier to design the power source module, resulting in a reduction of a manufacturing cost for the fluorescent luminous tube.

In case twelve filaments 11 are individually used, the twelve filaments 11 are connected in parallel and the current of about 27 mA should be applied to each of the twelve filaments 11. However, in case the twelve filaments 11 are grouped into four sets of the three filaments 11 in each set are connected in series, only the current of about 27 mA needs to be applied to each set, so that the total current flowing in the power source module can be reduced to ⅓. Therefore, if the three filaments 11 connected in series are used, an electric power wasted between the power source module and the filaments can be reduced. Further, the amount of heat generated in the power source module also decreases, so that it becomes much easier to cool down the power source module.

FIG. 1B shows an example where three sets of five filaments 11 are prepared, wherein the five filaments 11 in each set are connected in series between the terminal aluminum layer 131 of the cathode wiring 13 and the terminal aluminum layer 121 of the cathode wiring 12 via two intermediate aluminum layers 14 and two intermediate aluminum layers 15.

FIG. 1C describes an example where two sets of seven filaments are prepared, wherein the seven filaments 11 in a set are connected in series between the terminal aluminum layer 131 of the cathode wiring 13 and the terminal aluminum layer 121 of the cathode wiring 12 via three intermediate aluminum layers 14 and three intermediate aluminum layers 15.

As clearly seen from FIGS. 1A to 1C, even though the number of filaments 11 in each set is increased to 3, 5 and 7, the numbers of rows of the wiring aluminum layers 122 and 132, the terminal aluminum layers 121 and 131, and the intermediate aluminum layers 14 and 15 remain unchanged. In other words, even though the number of the filaments 11 in each set is increased, a set of terminal aluminum layers 121 and intermediate aluminum layers 15 can be prepared in one row and that of terminal aluminum layers 131 and intermediate aluminum layers 14 also can be provided in one row, and such increased number of filaments can be accommodated by adjusting the number of layers in each row. Accordingly, even though the number of filaments 11 in each set is increased, no additional space is required for installing the wiring aluminum layers 122 and 132, terminal aluminum layers 121 and 131 and the intermediate aluminum layers 14 and 15.

The wiring aluminum layers 122 and 132 are electrically connected to the terminal aluminum layers 121 and 131, respectively. The wiring aluminum layers 122, 132 and the terminal aluminum layers 121, 131 can be formed either separately or simultaneously. If they are formed in one processing step, portions of the wiring aluminum layers 122, 132 on which the filaments 11 are fixed correspond to terminal aluminum layers 121 and 131, respectively. Further, the term 'row' used herein refers to not only an arrangement where involved parts are positioned in a straight line but also an arrangement where they are disposed along a substantially straight line.

Figure 2A:
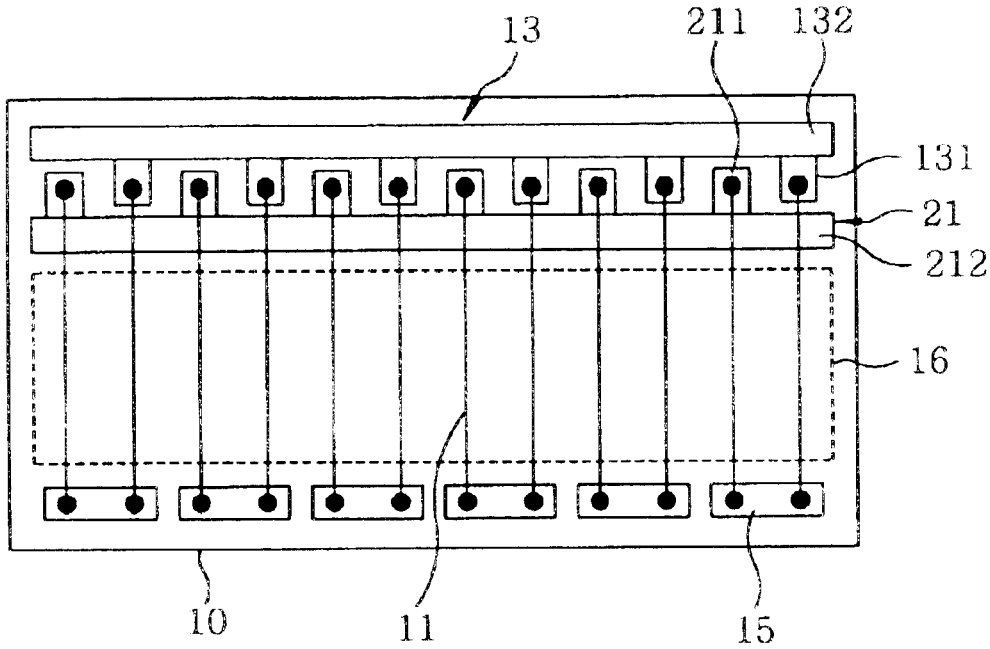
FIGS. 2A to 2C describe various connecting structures of cathode filaments of a fluorescent luminous tube in accordance with a second preferred embodiment of the present invention.
Figure 2B:
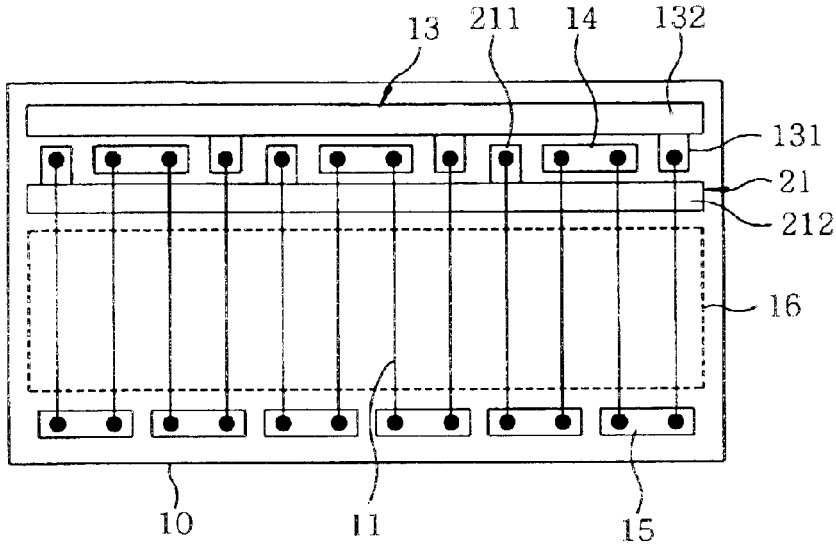
Figure 2C:
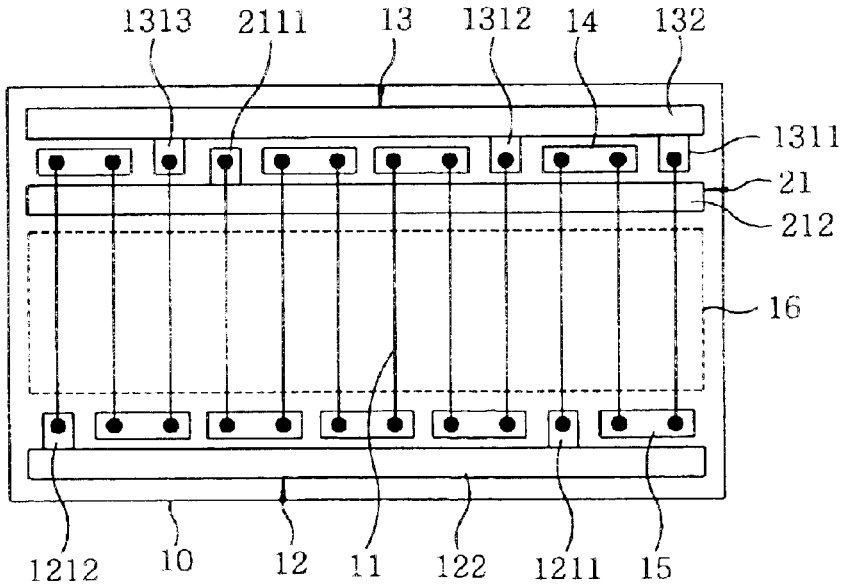

FIGS. 2A to 2C describe connecting structures of filaments included in a fluorescent luminous tube in accordance with a second preferred embodiment of the present invention.

FIGS. 2A and 2B provide examples where each filament set has even number of filaments connected in series, while FIG. 2C describes an example where there exist filament sets of even and odd number of filaments connected in series. Referring to FIG. 2A, arranged at one side of a display region 16 are wiring aluminum layers 132 and 212 and terminal aluminum layers 131 and 211 of cathode wirings 13 and 21, respectively. Arranged at the other side of the display region 16 are only intermediate aluminum layers 15. No intermediate aluminum layers are disposed at the side of the cathode wirings 13 and 21. Two filaments 11 are connected in series between the terminal aluminum layer 131 of the cathode wiring 13 and the terminal aluminum layer 211 of the cathode wiring 21 via the one intermediate aluminum layer 15.

Referring to FIG. 2B, arranged at one side of the display region 16 are the wiring aluminum layers 132 and 212 and the terminal aluminum layers 131 and 211 of the cathode wirings 13 and 21, respectively, as well as a plurality of intermediate aluminum layers 14. Arranged at the opposite side of the display region is only the plurality of intermediate aluminum layers 15. Four filaments 11 are connected in series between the terminal aluminum layer 131 of the cathode wiring 13 and the terminal aluminum layer 211 of the cathode wiring 21 via the intermediate aluminum layers 14 and 15.

Referring to FIG. 2C, arranged at one side of the display region 16 are the wiring aluminum layers 132 and 212 and terminal aluminum layers 1311 to 1313 and 2111 of the cathode wiring 13 and 21, respectively, as well as a plurality of intermediate aluminum layers 14. Prepared at the opposite side of the display region 16 are the wiring aluminum layer 122 and terminal aluminum layers 1211 and 1212 of the cathode wiring 12 and a plurality of intermediate aluminum layers 15.

Three filaments 11 are connected in series between the terminal aluminum layer 1311 of the cathode wiring 13 and the terminal aluminum layer 1211 of the cathode wiring 12 via intermediate aluminum layers 14 and 15. Six filaments 11 are connected in series between the terminal aluminum layer 1312 of the cathode wiring 13 and the terminal aluminum layer 2111 of the cathode wiring 21 via intermediate aluminum layers 14 and 15. Three filaments 11 are connected in series between the terminal aluminum layer 1313 of the cathode wiring 13 and the terminal aluminum layer 1212 of the cathode wiring 12 via intermediate aluminum layers 14 and 15.

The cathode wirings 12 and 21 respectively disposed at the two opposite sides of the display region 16 are electrically connected at either inside or outside of the fluorescent luminous tube in such a manner that they have an identical electric potential. Therefore, the three cathode wirings 12, 13 and 21 are involved in one wiring set in this case.

In FIG. 2C, there are illustrated three filament sets; two of them include three filaments 11 connected in series and the other set includes six filaments 11 connected in series. In this case, the filaments 11 in the set of six are thicker than those in the other two sets of three, and the resistance of one filament in the set of six is half of that of one filaments belonging to the other two sets of three.

Figure 3A:
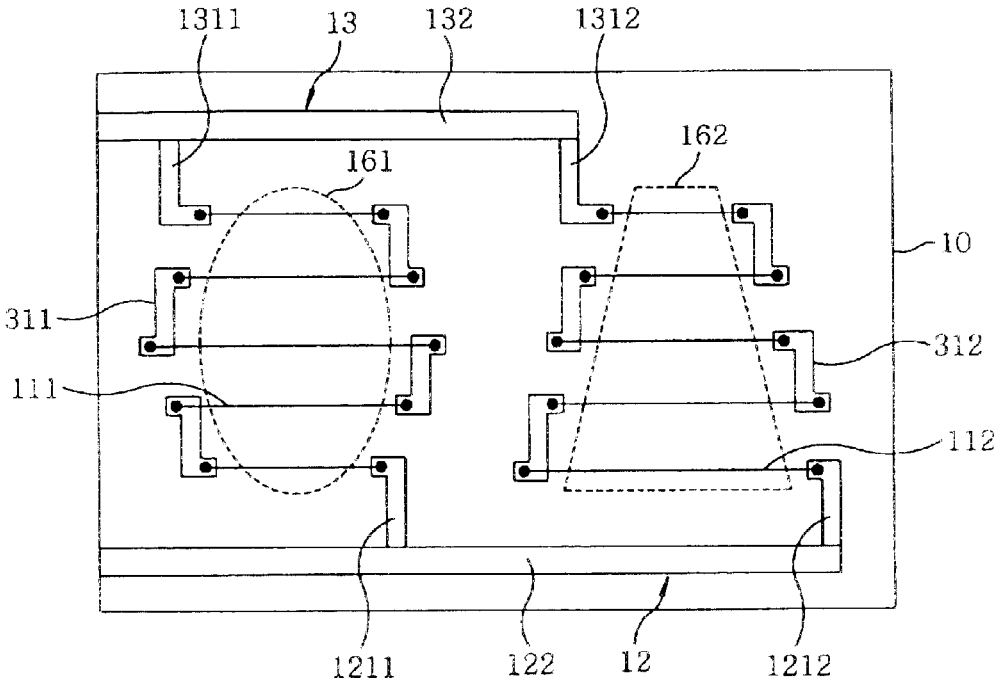
FIGS. 3A and 3B illustrate various connecting structures of cathode filaments of a fluorescent luminous tube in accordance with a third preferred embodiment of the present invention.
Figure 3B:
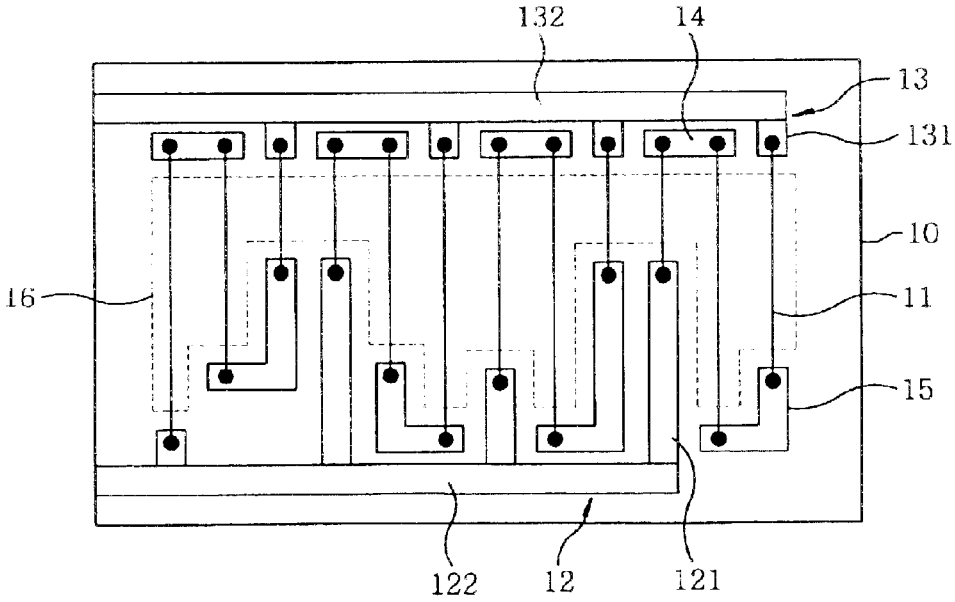

FIGS. 3A and 3B describe connecting structures of filaments included in a fluorescent luminous tube in accordance with a third preferred embodiment of the present invention.

FIG. 3A shows an example where a plurality of display regions exists in a single fluorescent luminous tube, e.g., in case bar graphs having different shapes and sizes are displayed in a rounded display region and display patterns having different shapes coexist. FIG. 3B depicts an example where the display region has a complicated shape.

Referring to FIG. 3A, reference numerals 111 and 112 indicate cathode filaments; 1211 and 1212, terminal aluminum layers of a cathode wiring 12; 1311 and 1312, terminal aluminum layers of a cathode wiring 13; 311 and 312, intermediate aluminum layers; and 161 and 162, display regions.

Five filaments 111 are installed in such a manner as to cover the display region 161. The five filaments 111 are connected in series between the terminal aluminum layer 1211 of the cathode wiring 12 and the terminal aluminum layer 1311 of the cathode wiring 13 via the four intermediate aluminum layers 311. Five filaments 112 are arranged in such a manner as to cover the display region 162. The five filaments 112 are connected in series between the terminal aluminum layer 1212 of the cathode wiring 12 and the terminal aluminum layer 1312 of the cathode wiring 13 via the four intermediate aluminum layers 312. The five filaments 111 have identical or different lengths and the same goes for the five filaments 112. Though the lengths of individual filaments 111 and 112 may differ from each other, the five filaments 111 between the terminal aluminum layer 1211 and the terminal aluminum layer 1311 are set to have a same series resistance value as that of the five filaments 112 between the terminal aluminum layer 1212 and the terminal aluminum layer 1312.

Referring to FIG. 3B, twelve filaments 11 are installed in such a manner as to cover a display region 16 having a complicated shape. The twelve filaments 11, each having one of three different lengths, are grouped into four sets of three. The filaments 11 in each set have three different lengths and are arranged differently in terms of their order of lengths. The cathode wiring 12 is provided with four terminal aluminum layers 121 and the cathode wiring 13 has four terminal aluminum layers 131. The three filaments 11 in each set are connected in series between two terminal aluminum layers 121 and 131 via two intermediate aluminum layers 14 and 15. The series resistance of each set of filaments 11 is identical.

Figure 4A:
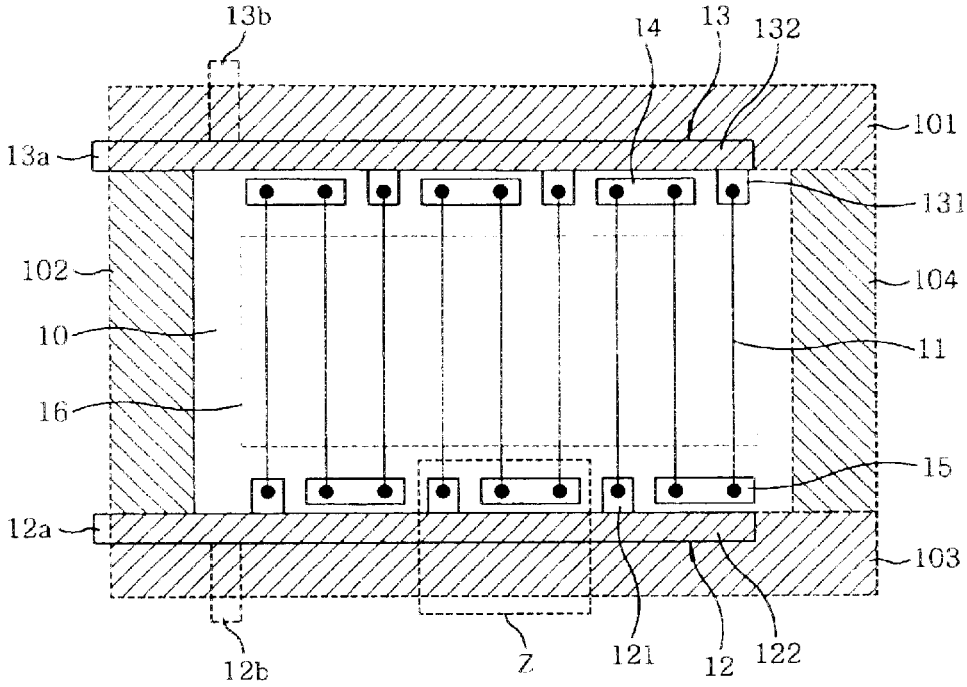
FIGS. 4A to 4D offer plan views (cross-sectional views for side plates) of a substrate on which filaments are installed in accordance with the preferred embodiment of the present invention.
Figure 4B:
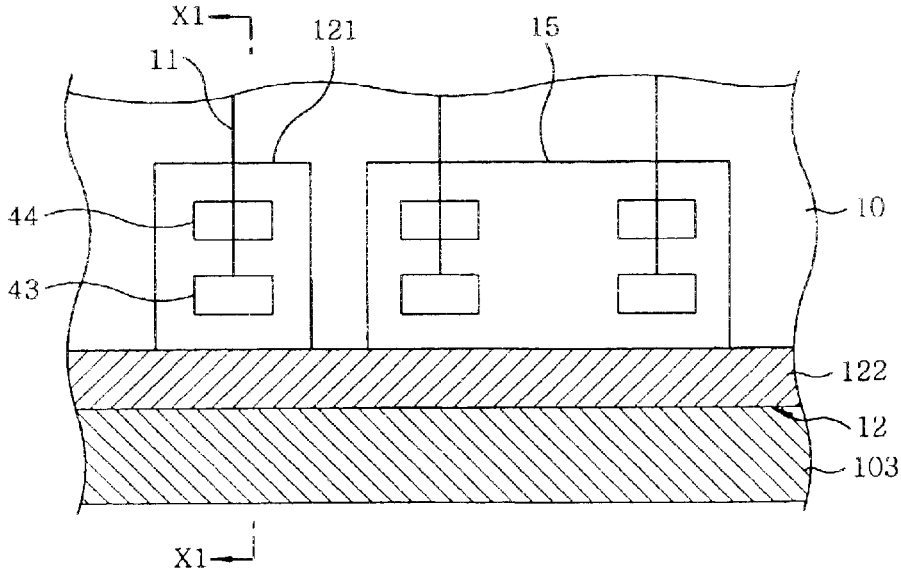

FIG. 4A shows a plan view (a cross-sectional view for side plates) of a substrate 10 on which filaments 11 are installed in accordance with the preferred embodiment of the present invention. FIG. 4B depicts an enlarged view of a portion Z in FIG. 4A and FIGS. 4C and 4D represent a cross-sectional view taken along the line X1—X1 shown in FIG. 4B.

In FIGS. 4A to 4D, reference numerals 101 to 104 denote side plates made of the insulating material such as glass or ceramic; 43, an aluminum wire bonded by the ultrasonic wire bonding technique; 44, a spacer aluminum wire fabricated by the ultrasonic wire bonding technique; and 45, an aluminum layer processed by an ultrasonic bonding technique.

Referring to FIG. 4A, a wiring aluminum layer 122 of the cathode wiring 12 is placed between the substrate 10 and the side plate 103, and a wiring aluminum layer 132 of the cathode wiring 13 is disposed between a substrate 10 and the side plate 101. Though it is possible that the wiring aluminum layers 122 and 132 are prepared inside the fluorescent luminous tube, such an arrangement is not preferable since in that case the wiring aluminum layers 122 and 132 occupy a certain space inside the fluorescent luminous tube, lowering the utilization efficiency of the limited inner volume of the fluorescent luminous tube. Terminal aluminum layers 121 and 131 and intermediate aluminum layers 15 and 14 also can be arranged between the substrate 10 and the side plates 103 and 101, respectively. Respective end portions 12*a* and 13*a* of the wiring aluminum layers 122 and 132 are taken out of the fluorescent luminous tube. The end portions 12*a* and 13*a* can be replaced with those 12*b* and 13*b* shown by the dotted lines, respectively.

Figure 4C:
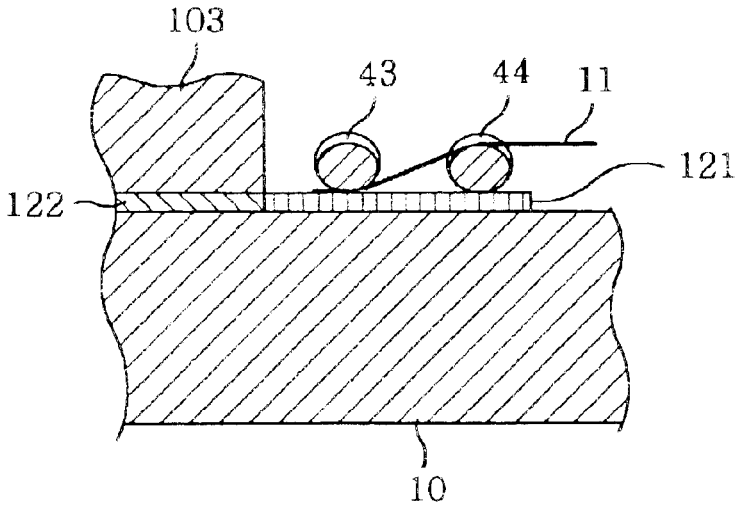
Figure 4D:
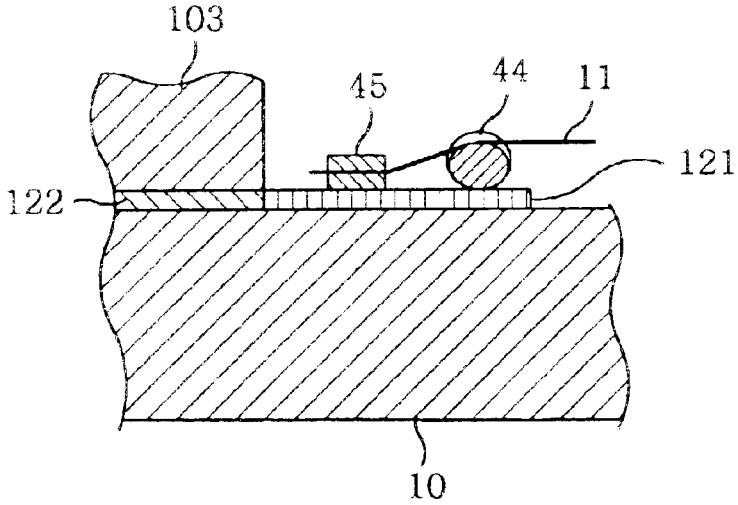
Figure 5A:
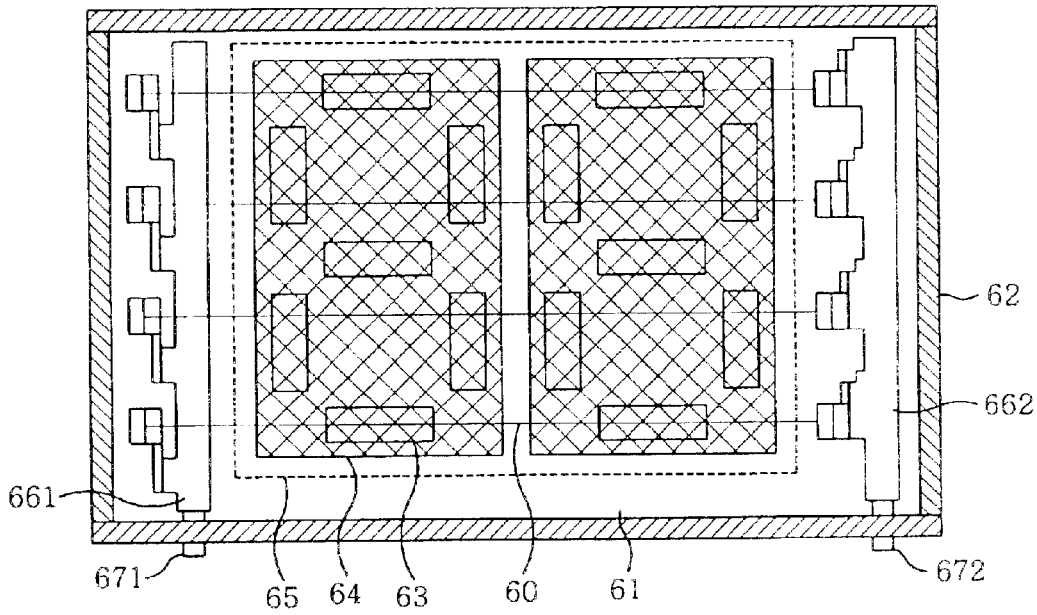
FIG. 5A (PRIOR ART)
FIGS. 5A to 5C provide plan views (partial cross-sectional views) of a conventional fluorescent luminous tube and schematic views of a connecting structure for cathode filaments thereof.
Figure 5B:
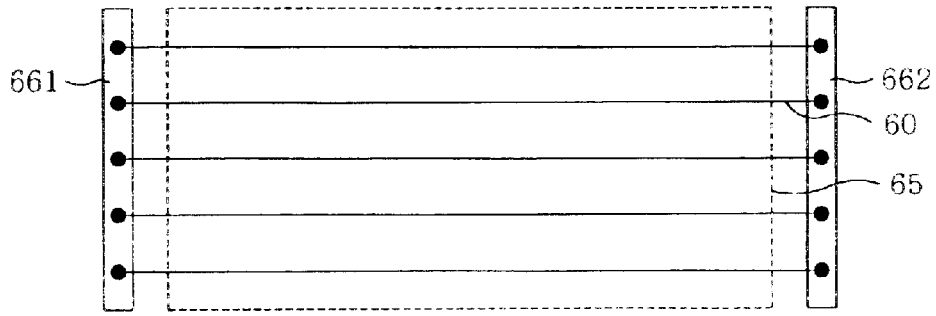
FIG.5B (PRIOR ART)
Figure 5C:
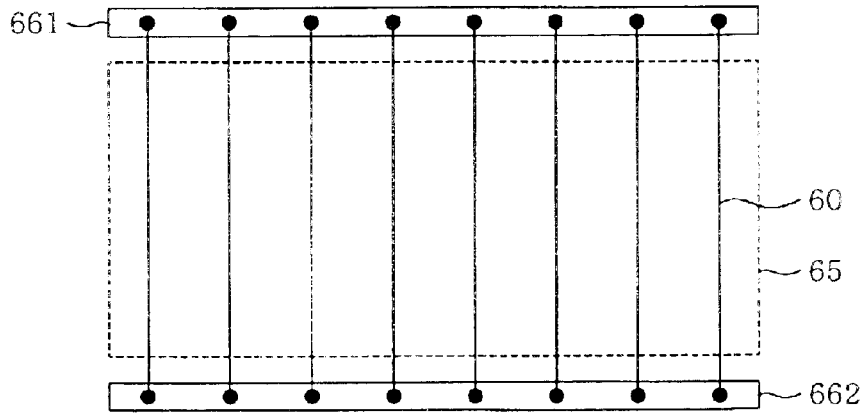
FIG.5C (PRIOR ART)
Figure 6A:
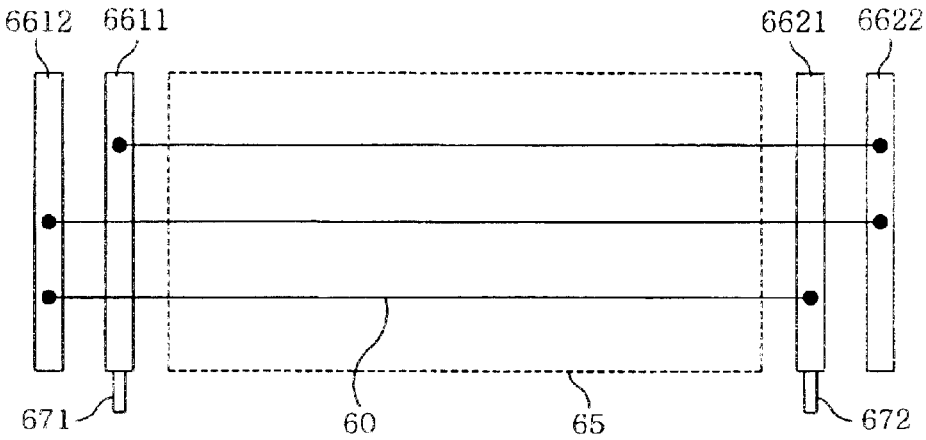
FIG. 6A (PRIOR ART)
FIGS. 6A to 6C depict various schemes conventionally employed in connecting filaments in series.
Figure 6B:
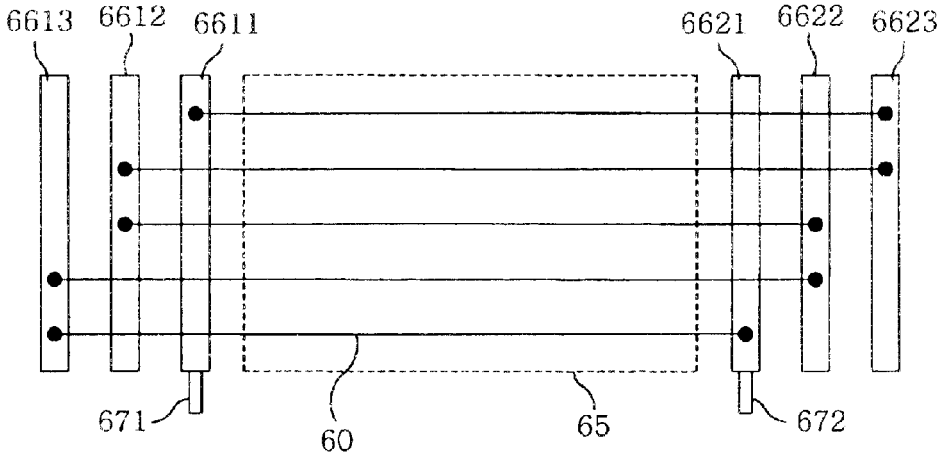
FIG. 6B (PRIOR ART)
Figure 6C:
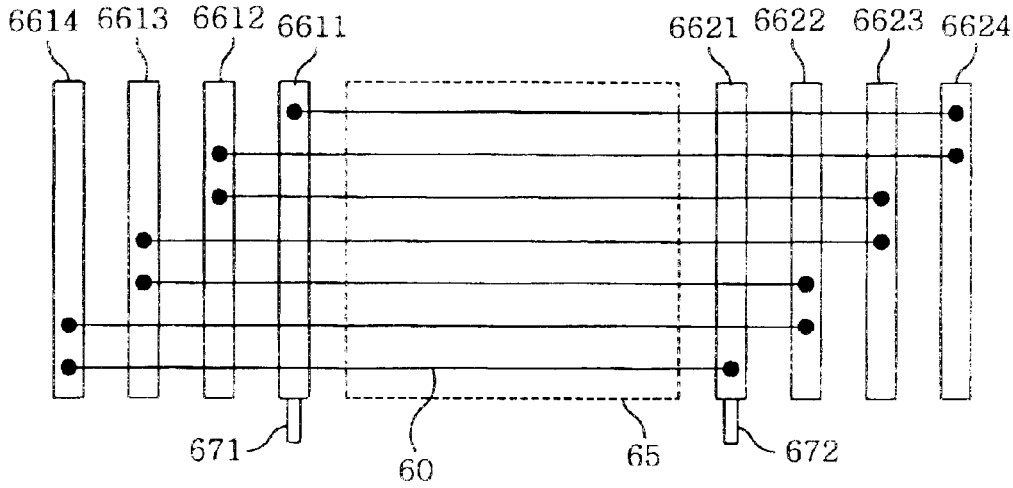
FIG. 6C (PRIOR ART)

Referring to FIGS. 4B and 4C, each end portion of the filaments 11 is fixed by the aluminum wires 43 on a terminal aluminum layer 121 or 131 or an intermediate aluminum layer 14 or 15 through the use of an ultrasonic wire boding process. Further, in order to maintain the filaments 11 at a predetermined height, the spacer aluminum wires 44 are placed between a filament 11 and the base aluminum layer 121, 131, 14 or 15 by using the ultrasonic wire bonding technique.

As shown in FIG. 4D, the filament 11 can be fixed on the base aluminum layer, e.g., the terminal aluminum layer 121, by using an aluminum layer 45 in lieu of the aluminum wire 43 in FIG. 4C. The aluminum layer 45 is fabricated by coating a core wire of the filament 11. The aluminum layer 45 is fixed on the base layer by using the ultrasonic bonding technique instead of the ultrasonic wire boning technique as employed in FIG. 4C.

An insulation material such as a glass fiber or a ceramic bar can be used in lieu of the spacer aluminum wires 44 shown in FIGS. 4A to 4D on the terminal aluminum layers 121 and 131, the intermediate aluminum layers 14 and 15, or the substrate 10 through the use of a frit glass.

In FIGS. 4B to 4D, each filament 11 needs to be partially or entirely of a coil shape in order for each filament 11 to be stretched tightly by the tensile force generated by the resilience of the coil-shaped portion thereof. If a filament is partially coil-shaped, it is preferable that one end or both end portions thereof are made to be of the coil shape.

The thickness of each of the side plates 101 to 104 is preferably 3 to 5 mm; the width of each of the wiring aluminum layers 122 and 132, 1 to 2 mm; the diameter of the aluminum wire 43, 100 to 500 $\mu$m; the diameter of each of the spacer aluminum layers 44, 300 to 350 $\mu$m; the thickness of each of the wiring aluminum layers 122 and 132, the terminal aluminum layers 121 and 131 and the intermediate aluminum layers 14 and 15, 1.2 to 2.0 $\mu$m; the thickness of each of the aluminum layers 45, 1.2 to 2.0 $\mu$m; and the diameter of each end portion of the filaments 11, 20 $\mu$m.

Since the filaments 11 are fixed on the terminal aluminum layers 121 and 131 and the intermediate aluminum layers 14 and 15 by employing the ultrasonic wire bonding or the ultrasonic bonding technique in the preferred embodiments in accordance with the present invention, the damage on the aluminum layers and/or crack generation in the substrate 10 or the like due to the heat generation during the bonding process can be avoided. Even in case where the terminal aluminum layers 121 and 131 and the intermediate aluminum layers 14 and 15 are thin films having a thickness of about 1.2 to 2.0 $\mu$m, no damage is incurred to those aluminum layers.

Further, since the filaments 11 are directly fixed on the terminal aluminum layers 121 and 131 and the intermediate aluminum layers 14 and 15 prepared on the substrate 10 by employing the ultrasonic wire bonding or the ultrasonic bonding technique, it becomes much easier and faster to install the filaments 11 in the preferred embodiments of the present inventions than in the conventional cases where the filaments 11 are mounted on metal parts such as a filament anchor and a filament support. Accordingly, the manufacturing cost for the fluorescent device can be decreased.

In the preferred embodiments of the present invention described above, an anode substrate or a front substrate can be employed as a substrate on which filaments are installed, as in the conventional fluorescent luminous tubes.

If the filaments are installed on the anode substrate, intermediate aluminum layers and cathode wirings including wiring aluminum layers and terminal aluminum layers can be concurrently fabricated together with anode electrodes and/or take-out wirings (anode wirings) thereof, so that a manufacturing cost can be reduced. On the other hand, if the filaments are installed on the front substrate, only the arrangement of tin oxide films (formed if necessary) needs to be considered in arranging the aluminum layers for filament installation, allowing more freedom in the arrangement thereof. This advantage is particularly useful in case the display region has a complicated shape. Further, if the filaments are installed on the front substrate, the aluminum layers are fabricated independently of the processes for the anode substrate, so that the anode substrate is still usable even for a case of a failure in the installation of the filaments. Therefore, both the throughput and the quality of the fluorescent luminous tube can be improved.

The wiring aluminum layers, the terminal aluminum layers, the intermediate aluminum layers, the aluminum wires and the aluminum layers in the preferred embodiments of the present invention can be formed of a metal, e.g., copper, gold, silver, platinum or vanadium, other than aluminum.

Even though the present invention has been described with regard to the fluorescent luminous tube, the present invention can also be applied to any other type devices, e.g., a fluorescent luminous tube for print head or a flat cathode-ray tube (CRT), which employ the principle of the fluorescent luminous tube described above.

The filaments have been described to run parallel in the above-described preferred embodiments of the present invention. However, it will be apparent to those skilled in the art that the filaments can also be arranged in a non-parallel manner.

The present invention allows a desired number of filament sets including even or odd number of filaments connected in series to be coupled in parallel by a simple method of forming wiring metal layers and intermediate metal layers of a set of cathode wirings which respectively have a terminal portion. Further, filament sets including even and odd number of filaments can also be connected in parallel by forming wiring metal layers and intermediate metal layers of three cathode wirings which respectively have a terminal portion.

As described above, the present invention provides a simple method for connecting a plurality of filaments in series. Accordingly, if the employed filaments differ from each other in length and thickness, and, thus, their resistances are also different, those filaments can be grouped into several sets of filaments connected in series in such a manner that the series resistance of each set becomes substantially identical. As a result, a single filament power source having a predetermined voltage can be used in various types of fluorescent luminous tubes employing filaments of different lengths and diameters in accordance with the present invention, which is different from conventional cases where an individual power source module is required for every filament having a different resistance. Therefore, the cost for the power source modules can be reduced.

Further, if the employed filaments have a small resistance for some reasons, e.g., due to a short length thereof, a filament power source is required to have a small voltage as well in accordance with the prior art. Moreover, since a permitted fluctuation value for an output voltage of the filament power source is reduced as the filament voltage is decreased, a high degree of precision is required to control the output voltage generated from the filament power source having the small voltage, resulting in an increase of the cost for the power source modules. In accordance with the present invention, however, the filaments having a small resistance are connected in series and are utilized as one group, so that the involved resistance is increased and a filament power source having a large voltage is utilized. If the filament voltage is increased, the permitted fluctuation value is also increased, thereby allowing for a simple control of the power source module.

Still further, arrangements of filaments can be easily modified according to various display patterns of a fluorescent luminous tube by a simple method of changing positions of terminal metal layers of cathode wirings and intermediate metal layers.

Still further, since the filaments are directly fixed on the terminal metal layers and the intermediate metal layers by employing an ultrasonic wire bonding or an ultrasonic bonding technique, and filament spacers are installed thereon by using metal wires through the use of the ultrasonic wire bonding technique, a footprint for mounting the filaments and the spacers and their installation heights can be reduced in comparison with conventional cases where anchors and supports are utilized. Therefore, it becomes easier to obtain a scaled-down, thin and light-weighted fluorescent luminous tube.

While the invention has been shown and described with respect to the preferred embodiments, it will be understood by those skilled in the art that various changes and modifications may be made without departing from the spirit and scope of the invention as defined in the following claims.

What is claimed is:

1. A fluorescent luminous tube comprising:

a plurality of cathode filaments;

a multiplicity of cathode wirings, each cathode wiring including one or more terminal portions and a wiring portion and being formed of a metal layer; and one or more intermediate portions, each being made of a metal layer, wherein the cathode filament is grouped into at least one set of one or more filaments and filaments in each set are connected in series by fixing an end portion thereof on a terminal portion or an intermediate portion by ultrasonic wire bonding or ultrasonic bonding.

2. The fluorescent luminous tube of claim 1, wherein the number of cathode wirings is two, the two cathode wirings being respectively provided in two opposite sides of a display region of the fluorescent luminous tube, and the terminal portions and the intermediate portions are disposed in two rows along the two opposite sides of the display region.

3. The fluorescent luminous tube of claim 1, wherein the number of cathode wirings is two, the two cathode wirings being arranged in one side of two opposite sides of a display region of the fluorescent luminous tube; the terminal portions are disposed in a row along said one side of the two opposite sides; and the intermediate portions are arranged in a row along the remaining side of the two opposite sides.

4. The fluorescent luminous tube of claim 1, wherein the number of cathode wirings is two, the two cathode wirings being arranged in one side of two opposite sides of a display region of the fluorescent luminous tube; the terminal portions and a part of the intermediate portions are disposed in a row along said one side of the two opposite sides; and the remaining part of the intermediate portions are arranged in a row along the remaining side of the two opposite sides.

5. The fluorescent luminous tube of claim 1, wherein the number of cathode wiring is three and a first and a second cathode wiring of the three cathode wirings are at an identical electrical potential.

6. The fluorescent luminous tube of claim 5, wherein the first cathode wiring is arranged in a first side of two opposite sides of a display region of the fluorescent luminous tube and two remaining cathode wirings are arranged in a second side of the two opposite sides, and wherein terminal portions of the first cathode wiring and a part of the intermediate portions are arranged in a row in the first side and terminal portions of the two remaining cathode wirings and the remaining part of the intermediate portions are arranged in a row in the second side.

7. The fluorescent luminous tube of claim 1, wherein each of the wiring portions and the terminal portions and the intermediate portions is made of a thin or a thick film.

* * * * *